US005543903A

United States Patent [19]

Fujita et al.

[11] Patent Number: 5,543,903

[45] Date of Patent: Aug. 6, 1996

[54] HEAT ROLLER TYPE TONER IMAGE FIXING DEVICE HAVING CLEANING ROLLER

[75] Inventors: Nobuo Fujita; Hideyuki Nanba; Masato Kawashima; Akihiro Komuro; Susumu Fujishima; Toshihiro Matsui, all of Kawasaki, Japan

[73] Assignee: Fujitsu Limited, Kawasaki, Japan

[21] Appl. No.: 368,762

[22] Filed: Jan. 4, 1995

Related U.S. Application Data

[63] Continuation of Ser. No. 60,936, May 13, 1993, abandoned.

[30] Foreign Application Priority Data

May 13, 1992 [JP] Japan ..... 4-120402
Sep. 29, 1992 [JP] Japan ..... 4-260340

[51] Int. Cl.[6] ..... G03G 15/20; G03G 21/00

[52] U.S. Cl. ..... 355/283; 355/284; 15/256.51

[58] Field of Search ..... 355/283, 296, 355/200, 210, 284, 285; 219/216, 388; 15/256.51, 256.52, 256.53; 101/483, 425

[56] References Cited

U.S. PATENT DOCUMENTS

| | | | |
|---|---|---|---|
| 3,649,992 | 3/1972 | Thettu | 15/256.52 |
| 3,716,221 | 2/1973 | Gorka et al. . | |
| 3,861,860 | 1/1975 | Thettu et al. | 355/283 X |
| 3,861,861 | 1/1975 | Thettu | 355/283 X |
| 3,980,424 | 9/1976 | Latone | 355/283 X |
| 4,009,953 | 3/1977 | Ravizza et al. . | |
| 4,137,597 | 2/1979 | Achenbach et al. . | |
| 4,231,653 | 11/1980 | Nagahara et al. | 355/283 |
| 4,866,482 | 9/1989 | Hirasawa et al. | 355/260 |
| 4,899,197 | 2/1990 | Davis et al. . | |
| 5,047,809 | 9/1991 | Owada et al. | 355/284 |

FOREIGN PATENT DOCUMENTS

| | | |
|---|---|---|
| 2550195A1 | 11/1975 | Germany . |
| 2653519B1 | 11/1976 | Germany . |
| 1-206382 A | 8/1989 | Japan . |

OTHER PUBLICATIONS

English Abstract of Japanese Patent Publication 57–105760, Publication Date Jul. 1, 1982.
English Abstract of Japanese Patent Publication 3–144679, Publication Date Jun. 20, 1991.

*Primary Examiner*—R. L. Moses
*Attorney, Agent, or Firm*—Staas & Halsey

[57] ABSTRACT

A toner image fixing device includes a heat roller, and a backup roller engaged with the heat roller to form a nip therebetween. A paper carrying a toner image is passed through the nip whereby the toner image is thermally fused and fixed on the paper. The heat roller, which is stained by a part of the fused toner during the fixing process, should be cleaned before a toner image is fixed on a successive paper without staining. To this end, a cleaning roller made of a felt material is pressed against the heat roller so as to be rotated together with the heat roller by a frictional force acting therebetween. The cleaning roller must be periodically replaced. The fixing device is constituted such that the replacement of the cleaning roller can be easily and quickly carried out.

24 Claims, 14 Drawing Sheets

HEAT ROLLER TYPE TONER IMAGE FIXING DEVICE HAVING CLEANING ROLLER

This application is a continuation of application Ser. No. 08/060,936, filed May 13, 1993, now abandoned.

BACKGROUND OF THE INVENTION

1) Field of the Invention

The present invention generally relates to an image formation apparatus such as an electrophotographic recording apparatus including a toner image carrying body such as a photosensitive drum, a dielectric drum or the like to which a toner image obtained from toner development of an electrostatic latent image is electrostatically adhered and held, and from which the toner image is electrostatically transferred to a recording medium such as a sheet of paper, and in particular, relates to a toner image fixing device incorporated therein for thermally fusing and fixing the toner image on the recording medium.

2) Description of the Related Art

As a representative example of the image formation apparatus as mentioned above, an electrophotographic recording apparatus is well known, wherein the following processes are typically carried out:

a) a uniform distribution of electrical charges is produced on a surface of an electrostatic latent image carrying body;

b) an electrostatic latent image is formed on a charged area of the body surface by an optical writing means such as a laser beam scanner, an LED (light emitting diode) array, a liquid crystal shutter array or the like;

c) the latent image is developed as a visible image with a developer or toner, which is electrically charged to be electrostatically adhered to the latent image zone;

d) the developed and charged toner image is electrostatically transferred from the body to a recording medium such as a sheet of paper; and e) the transferred toner image is fixed and recorded on the paper.

Typically, the electrostatic latent image carrying body may be an electrophotographic photoreceptor, usually formed as a drum, called a photosensitive drum, having a cylindrical conductive substrate formed of a metal such as aluminum, and a photoconductive insulating film bonded to a cylindrical surface thereof and formed of an organic photoconductor (OPC), a selenium photoconductor or the like.

In the toner image fixing process, a heat roller type toner image fixing device is widely used, which comprises a heat roller, and a backup roller engaged with the heat roller to form a nip therebetween, and a sheet of paper carrying a toner image is passed through the nip in such a manner that the toner image is in direct contact with the heat roller, whereby the toner image is thermally fused and fixed on the paper. During the passage of the paper through the nip between the rollers, a small part of the fused toner is adhered to a surface of the heat roller, and, when no sheet of paper is passed through the nip, the toner adhered thereto is partially transfered to the backup roller. Of course, the fused toner adhered to the rollers stains sheets of paper which are successively fed to the toner fixing device.

For this reason, conventionally, a cleaning member is applied to the heat roller to remove the fused toner adhered thereto. As one type of cleaning member, a bar type cleaning member is well known, which includes an elongated bar element and a cleaning element attached thereto and made of a suitable cleaning material such as felt. The bar type cleaning member is provided in the fixing device such that the felt element is pressed against the surface of the heat roller, whereby a removal of the fused toner from the heat roller can be carried out. Nevertheless, this type of cleaning member must be frequently exchanged with a new one, because the cleaning area of the felt element is small.

As another type of cleaning member, a roller type cleaning member is also well known, which includes a shaft element, and a cleaning roller element mounted thereon and made of a cleaning material such as felt. The roller type cleaning member is provided in the fixing device such that the roller element is pressed against the surface of the heat roller. During the cleaning, the roller type cleaning member is rotated to remove the fused toner from the heat roller. This type cleaning member has a larger cleaning area than that of the bar type cleaning member, and thus frequency of exchanging the cleaning member is considerably low in comparison with the bar type cleaning member. Nevertheless, the exchange of the roller type cleaning member is troublesome because the shaft element of the cleaning member is supported at the ends thereof by a pair of bearings attached to a frame of the fixing device.

SUMMARY OF THE INVENTION

Therefore, an object of the present invention is to provide a toner image fixing device comprising a heat roller, a backup roller engaged therewith to form a nip therebetween for passing a recording medium carrying a toner image to thermally fuse and fix the toner image on the recording medium, and a roller type cleaning member provided to remove a fused toner adhered to the heat roller therefrom, which device is constituted such that an exchange of the roller type cleaning member can be easily carried out.

In accordance with a first aspect of the present invention, there is provided a toner image fixing device which comprises a heat roller means rotationally driven in a direction for passing a recording medium with a toner image therethrough to thermally fuse and fix the toner image on the recording medium, a cleaning roller means pressed against the heat roller means to be rotated together therewith for cleaning the heat roller means stained with the fused toner image, and a frame means for rotatably supporting the cleaning roller means. The cleaning roller means has two bearing elements by which the two ends of the cleaning roller means are rotatably received, and the frame means has two holes aligned with and spaced from each other such that the cleaning roller means is longitudinally introduced into the aligned holes, whereby the bearing elements are detachably received in and held by the aligned holes.

In this fixing device, the frame means may include a first holder means provided in one of the holes to be resiliently engaged with the corresponding one of the bearing elements, and the first holder means may be a socket type holder. Also, the frame means may include a second holder means provided beside the other hole to be resiliently engaged with the other bearing element, and the second holder means may be a leaf spring type holder.

In accordance with the first aspect of the present invention, there also is provided a toner image fixing device which comprises a heat roller means rotationally driven in a direction for passing a recording medium with a toner image therethrough to thermally fuse and fix the toner image on the recording medium, a cleaning roller means pressed against the heat roller means to be rotated together therewith for cleaning the heat roller means stained with the fused toner image, and a frame means for rotatably supporting the cleaning roller means. The cleaning roller means has a first bearing element by which an end of the cleaning roller means is rotatably received, and the frame means has two holes aligned with and spaced from each other such that the cleaning roller means is longitudinally introduced into the aligned holes in such a manner that a free end of the cleaning roller means is defined as a leading edge, whereby the first bearing element and the free end are detachably received in and held by the aligned holes, respectively.

In this fixing device, the frame means may include a second bearing element provided in the hole associated with the free end of the cleaning roller means, and the free end is received in and held by the second bearing element. Also, the frame means may include a holder means provided beside the hole associated with the first bearing element, to be resiliently engaged therewith, and the holder means may be a leaf spring type holder.

In accordance with a second aspect of the present invention, there is provided a toner image fixing device which comprises a heat roller means rotationally driven in a direction for passing a recording medium with a toner image therethrough to thermally fuse and fix the toner image on the recording medium, a cleaning roller means pressed against the heat roller means to be rotated together therewith for cleaning the heat roller means stained with the fused toner image, a frame means having two slots aligned with and spaced from each other such that two ends of the cleaning roller means are laterally introduced into the aligned holes, and a removable constraint means for detachably constraining the ends of the cleaning roller means in the slots such that the cleaning roller is rotatably supported by the frame means.

In this fixing device, the removable constraint means may include a resilient means for resiliently constraining the ends of the cleaning roller means in the slots. Also, preferably, the constraint means is supported by a movable member which is movable between a first position that allows the constraint means to constrain the ends of the cleaning roller means and a second position that makes it impossible for the constraint means to constrain the ends of the cleaning roller means. The fixing device may further comprise a resilient tension means for resiliently keeping the movable member at the first position. Also, the resilient tension means may be arranged so as to resiliently keep the movable member at the second position when the movable member is moved to clear a dead point.

In the fixing devices as mentioned above, preferably, the cleaning roller means includes a roller element made of a felt material, and only a central zone corresponding to a recording area of the recording medium may be impregnated with a silicone oil to facilitate the cleaning of the heat roller means. Also, preferably, a ratio between an outer diameter of the heat roller means and an outer diameter of the cleaning roller means is a non-integral number, whereby the cleaning roller means can be uniformly stained.

BRIEF DESCRIPTION OF THE DRAWINGS

Other objects and advantages of the present invention will be better understood from the following description, with reference to the accompanying drawings, in which.

DESCRIPTION OF THE PREFERRED EMBODIMENTS

Figure 1:
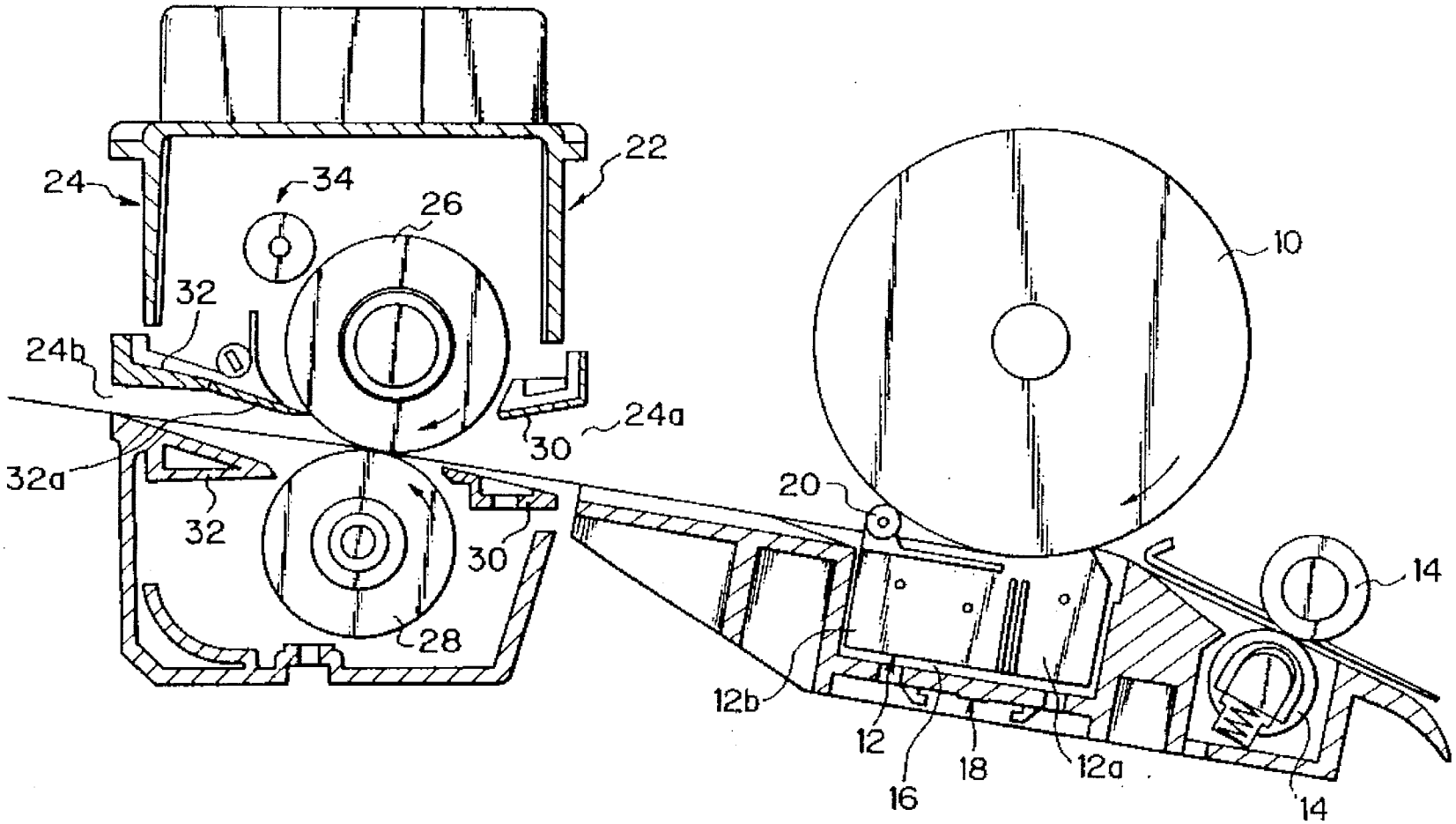
FIG. 1 is a schematic view of an electrophotographic recording apparatus using a toner image fixing device constituted according to a first aspect of the present invention.

FIG. 1 shows a part of an electrophotographic recording apparatus, in which the present invention is embodied, and which comprises a rotary photosensitive drum 10 formed as a latent image carrying body and rotated in a direction indicated by an arrow in FIG. 1 during an operation of the recording apparatus. The drum 10 may be made of an aluminum cylindrical hollow member and a photoconductive insulating film bonded to a cylindrical surface thereof. The photoconductive insulating film may be made of a selenium photoconductor, an organic photoconductor (OPC), or an amorphous silicone photoconductor (a-Si).

An electrically charged area is produced on the photosensitive drum 10 by, for example, an electric discharger (not shown) such as a corona discharger, and an electrostatic latent image is written on the charged area of the drum 10 by an optical writing means (not shown) such as a laser beam scanner, an LED (light emitting diode) array, a liquid crystal shutter array or the like. The latent image is electrostatically developed with an electrically charged toner or developer by a developing device (not shown), and the developed toner image is moved to a toner image transferring device 12 disposed beneath the drum 10 due to the rotation thereof. On the other hand, a recording medium such a sheet of paper is fed from a paper cassette (not shown), and, when the leading edge of the fed paper reaches a pair of register rollers 14 and 14, it is stopped once. Then, the paper is introduced, at a given timing, into a clearance between the drum 10 and the transferring device 12, so that the developed toner image can be electrostatically transferred to the paper in place.

In particular, The transferring device 12 includes a transfer charger 12*a*, and an AC charge eliminator 12*b* associated with and disposed adjacent to the transfer charger 12*a*. The transfer charger 12*a*, which may be a corona discharger, is subjected to an application of a DC electric energy to give the paper an electric charge having a polarity opposite to that of the electric charge of the developed toner image, whereby the toner image is electrostatically transferred from the photosensitive drum 10 to the paper. The AC charge eliminator 12*b*, which also may be a corona discharger, is subjected to an application of an AC electric energy to partially eliminate the electric charge of the paper to which the toner image is transferred, whereby an electrostatic attraction acting between the paper and the drum 10 can be weakened for an effective separation of the paper from the drum 10.

As shown in FIG. 1, the transferring device 12 is received in a recess 16 formed in a frame 18, and is provided with a pair of spacer rollers 20 displaced at side edges of the photosensitive drum 10. A leaf spring (not shown) is provided on the bottom of the recess 16 so that the transferring device 12 is resiliently biased toward the photosensitive drum 10, and thus the spacer rollers 20 are resiliently pressed against the surface of the drum 10 so that the clearance between the drum 10 and the transferring device 12 is kept constant even if the drum 10 does not have a perfect circular profile, to thereby ensure a stable transferring process.

The paper discharged from the clearance between the drum 10 and the transferring device 12, i.e., the paper with the transferred toner image, is then moved toward a toner image fixing device 22 for thermally fusing and fixing the toner image on the paper. The fixing device 22 comprises a casing 24, a heat roller 26 provided therein, and a backup roller 28 provided in the casing 24 and engaged with the heat roller 26 to form a nip therebetween, and the rollers 26 and 28 are suitably supported by side walls (not shown in FIG. 1) of the casing 24, and are rotated in respective directions indicated by arrows in FIG. 1 during an operation of the recording apparatus. The casing 24 has an inlet port 24*a* formed in a front wall thereof, and the paper is introduced into the nip between the rollers 26 and 28 through the inlet port 24*a*. While the paper is passed through said nip, the toner image thereon is in direct contact with the heat roller 26, and thus is thermally fused and fixed on the paper. The casing 24 also has an outlet port 24*b* formed in a rear wall thereof, and the paper carrying with the fixed toner image is discharged out of the fixing device 22 through the outlet port 24*b*.

Note, in FIG. 1, reference numeral 30 indicates a pair of paper guides by which the inlet port 24*a* is defined, and reference numeral 32 indicates a pair of paper guides by which the outlet port 24*b* is defined. One of the paper guides 32, i.e., the upper paper guide 32 is provided with a wedge shaped element 32*a* engaged with the surface of the heat roller 26 for mechanically separating the leading edge of the paper therefrom.

Figure 2:
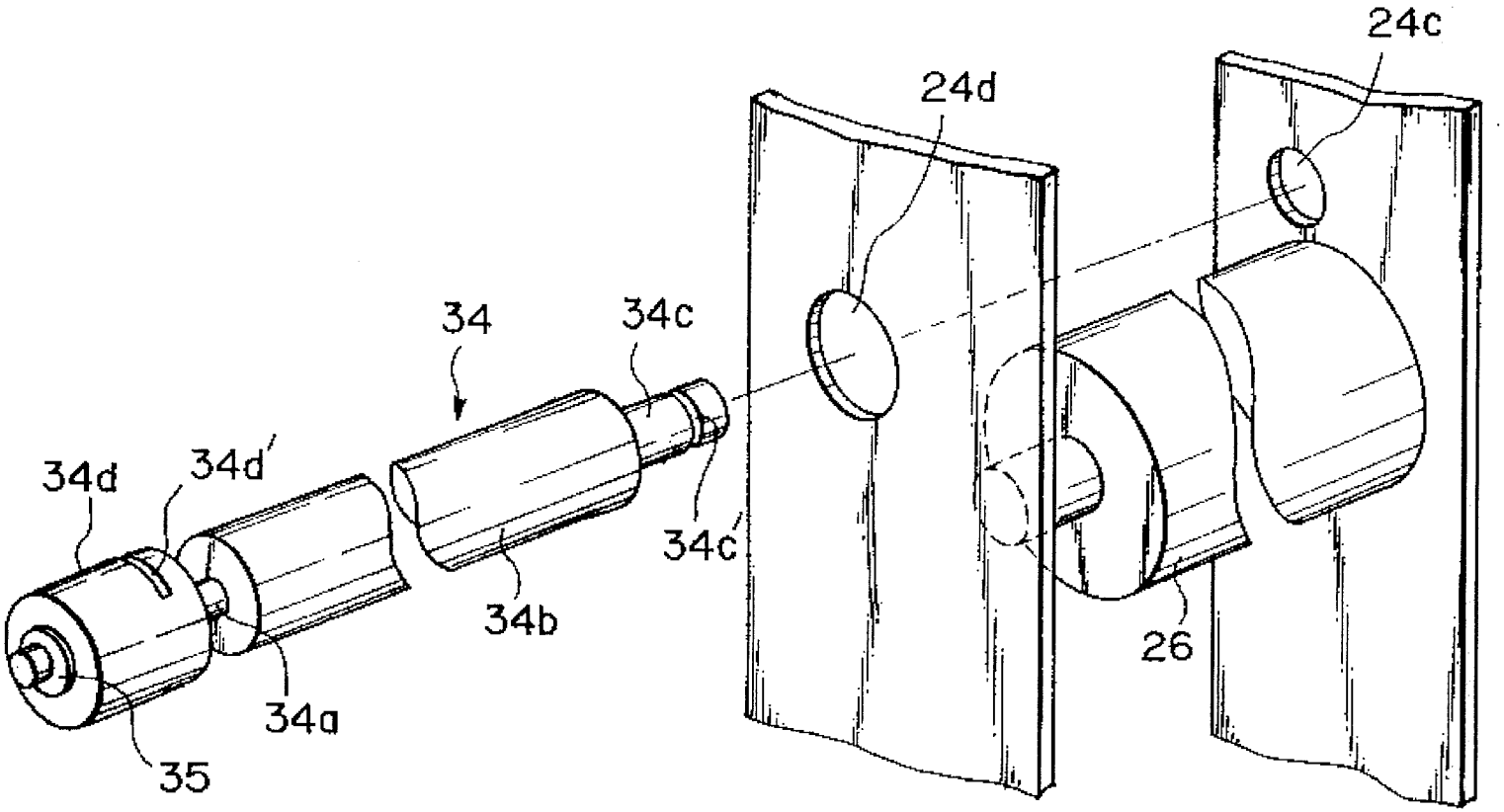
FIG. 2 is a perspective view showing some elements of the fixing device as shown in FIG. 1.
Figure 3:
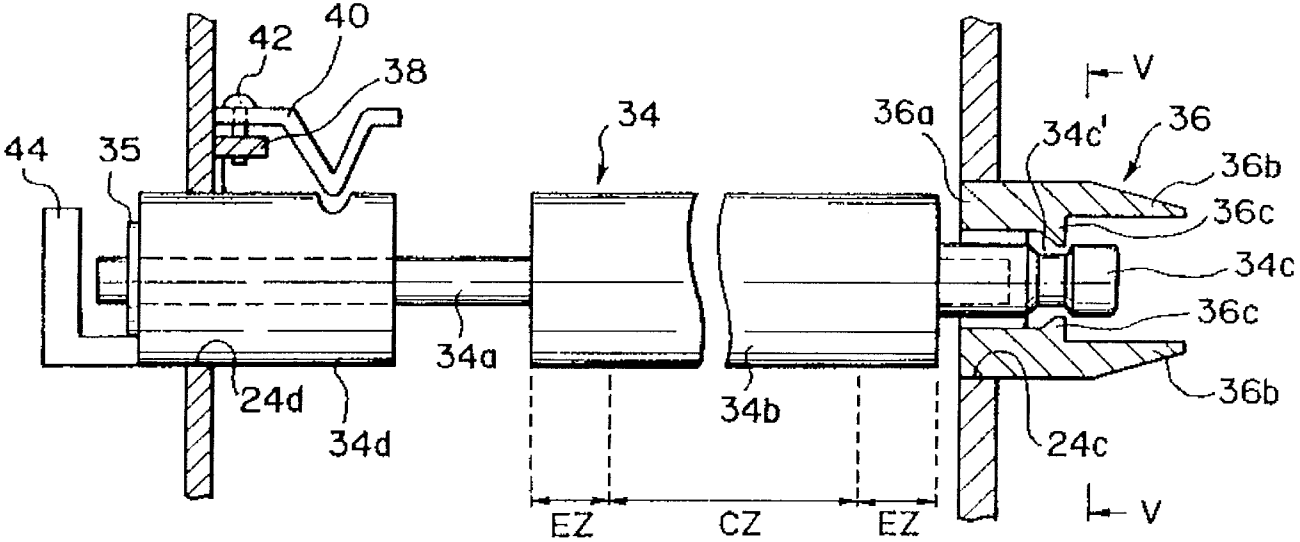
FIG. 3 is a partially sectional view showing of a cleaning roller member supported by a casing of the fixing device.

The toner image fixing device 22 further comprises a cleaning roller member 34 provided in the casing 24 and constituted according to the present invention. As shown in FIGS. 2 and 3, the cleaning roller member 34 includes a shaft element 34*a* made of a suitable metal material such as stainless steel, aluminum or the like, a cleaning roller element 34*b* mounted on the shaft element 34*a* and made of a suitable cleaning material such as felt (which is, for example, available as 545K from Toyobo K.K.), a first bearing element 34*c* provided on one end of the shaft element 34*a*, and a second bearing element 34*d* provided on the other end of the shaft element 34*a*. The cleaning roller element 34*b* may be formed by winding a strip-like felt material around the shaft element 34*a*. The first bearing element 34*c* has a cup-like shaped configuration with a closed outer end, and an annular groove 34*c*' formed therearound, as shown in FIG. 3. The cup-like shaped bearing element 34*c* rotatably receives the corresponding end of the shaft element 34*a* so as to be prevented from slipping therefrom. The second bearing element 34*d* has an arcuate groove 34*d*' formed therein, and is slidably and rotatably inserted onto the corresponding end of the shaft element 34*a*, but is prevented from slipping from said end by an E-ring 35 mounted thereon. According to the present invention, not only can the cleaning roller member 34 be incorporated in the fixing device 22, but also it can be removed therefrom, as mentioned below.

Figure 4:
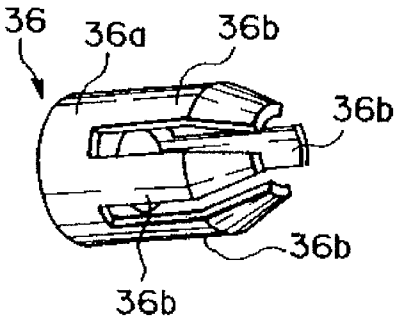
FIG. 4 is a perspective view of a socket member shown in FIG. 3.

In particular, respective holes 24*c* and 24*d* are formed in the side walls of the casing 24 so as to be aligned with each other, as shown in FIG. 2. A socket member 36 is securely fitted in the hole 24*c*, as shown in FIG. 3, and is preferably made of stainless steel. As apparent from FIGS. 3 and 4, the socket member 36 includes an annular element 36*a* having a larger inner diameter than an outer diameter of the first bearing element 34*c*, four resiliently flexible tongue-like elements 36*b* integrally projected therefrom and disposed at regular intervals, and four projections 36*c* inwardly protruded from the tongue-like elements 36*b*. A circle defined by four inner edges of the projections 36*c* has a diameter smaller than the outer diameter of the first bearing element 34*c*, but larger than an inner diameter of the annular groove 34*c*'. As shown in FIG. 3, a plate-like piece 38 is protruded from an inner face of the casing side wall in which the hole 24*d* is formed, and a V-shaped leaf spring member 40 is securely attached to the plate-like piece 38 by a screw 42 to be positioned just above the hole 24*d*. The second bearing element 34*d* has an outer diameter slightly smaller than a diameter of the hole 24*d*.

Figure 5:
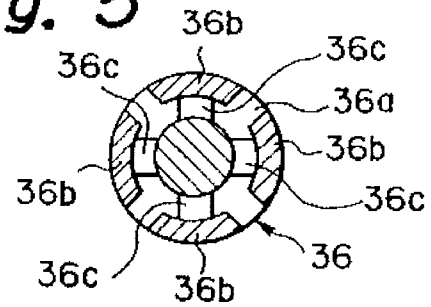
FIG. 5 is a cross-sectional view taken along line V—V of FIG. 3.

When the cleaning roller member 34 is incorporated in the fixing device 22, first, the first bearing element 34*c* is passed through the hole 24*d*, and is forcibly pushed in the socket member 36 so that the closed outer end or head of the first bearing element 34*c* can clear the projections 36*c* due to the resilient flexibility of the tongue-like elements 36*b*, whereby the projections 36*c* are engaged in the annular groove 34*c*' so that the first bearing element 34*c* is mechanically held in place by the socket member 36, as shown in FIGS. 3 and 5. At the same time, the V-shaped leaf spring 40 is snugly engaged in the arcuate groove 34*d*' of the second bearing element 34*d*, whereby the second bearing element 34*d* also can be mechanically held in place. Note, the cleaning roller element 34*b* is bulky enough to be pressed against the surface of the heat roller 26, so that the cleaning roller member 34 can be rotated together with the heat roller 26 by a friction force acting therebetween. On the other hand, removal of the cleaning roller member 34 from the fixing device 22 can be easily carried out by forcibly pulling out the cleaning roller member 34. All things considered, the cleaning roller member can be easily be exchanged by merely pulling out an old one and then by merely pushing in a new one.

During the operation of the recording apparatus, the projections 36*c* of the socket member 36 may be eventually disengaged from the annular groove 34*c*'. To prevent the eventual disengagement of the projections 36*c* from the annular groove 34*c*', the second bearing element 34*d* is preferably provided with a stopper element 44 supported thereby and disposed so as to face the corresponding end face of the shaft element 34*a*, as shown in FIG. 3. In this embodiment, although the stopper element 44 is provided on the second bearing element 34*d*, this stopper element may be attached to an inner wall of a movable door which is provided in a housing of the recording apparatus to access the fixing device 22 during an exchange of the cleaning roller member.

The cleaning roller element 34*b* may be impregnated with a silicone oil (which is, for example, available as SH 200 from Tore-Dow Corning Silicon K.K.) to facilitate a cleaning of the heat roller 26. In this case, the impregnation of the silicone oil should be restricted to only a central zone CZ of the cleaning roller element 34*b* corresponding to a recording zone of the paper. Namely, the end zones EZ of the cleaning roller element 36*b* are impregnated with no silicone oil. With this arrangement, the end zones EZ have a coefficient of friction larger than that of the central zone CZ impregnated with the silicone oil, so that a frictional engagement can be kept between the cleaning roller element 34*b* and the heat roller 26 to cause a frictional rotation of the cleaning roller member 34.

Figure 6:
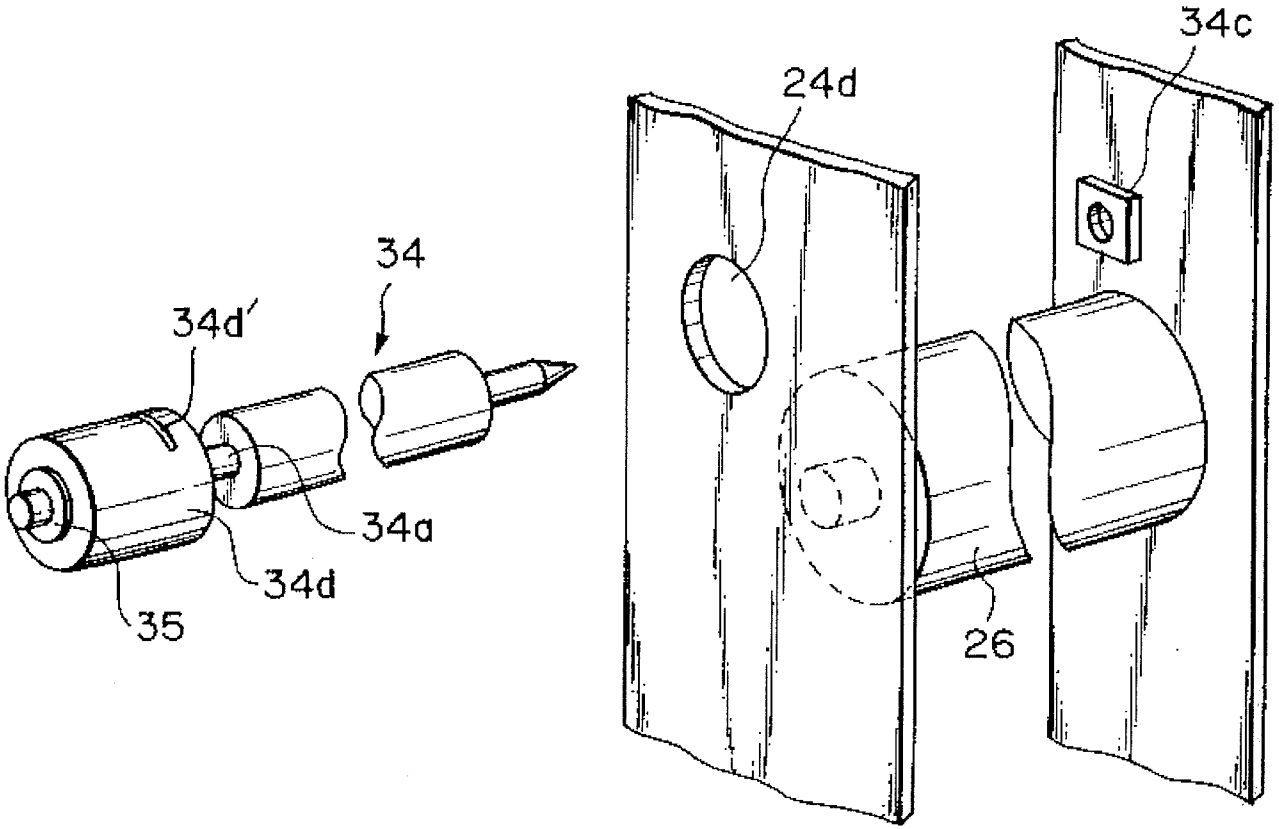
FIG. 6 is a perspective view showing a modification of the embodiment shown in FIG. 2.

FIG. 6 shows a modification of the embodiment shown in FIGS. 2 to 5. Note, in FIG. 6, the features similar to those of FIGS. 2 to 5 are indicated by the same references. In this modified embodiment, the first bearing element 34*c* is securely attached in the hole formed in the casing side wall concerned, and the end of the shaft member 34*a*, which can be defined as a leading end when incorporated in the toner image fixing device 22, is tapered so as to be easily inserted in the second bearing 34*c*. When the incorporation of the cleaning roller member 34 in the fixing device 22 is carried out, the second bearing element 34*d* is engaged with the V-shaped leaf spring, as shown in FIG. 3.

Figure 7:
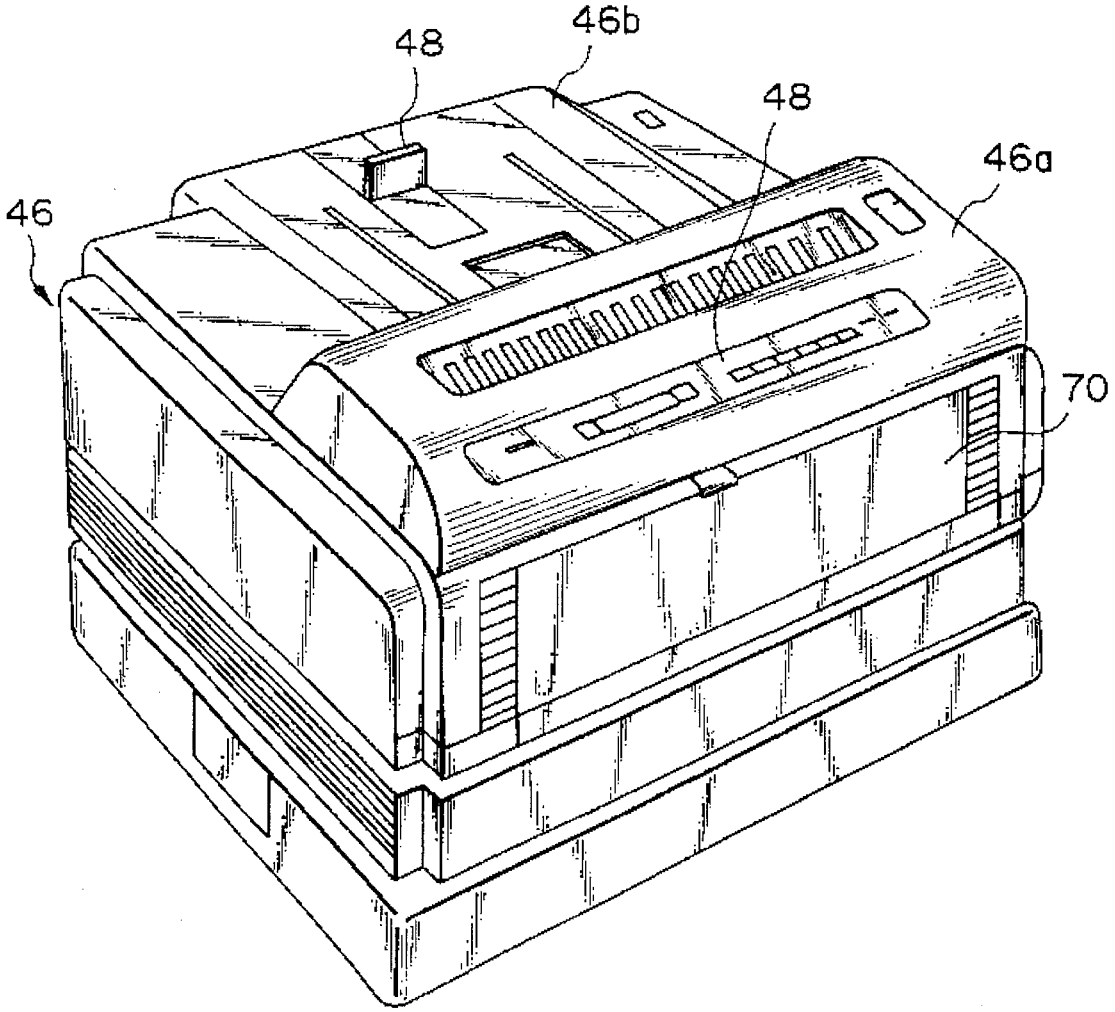
FIG. 7 is a perspective view of an electrophotographic laser printer using a toner image fixing device constituted according to a second aspect of the present invention.
Figure 8:
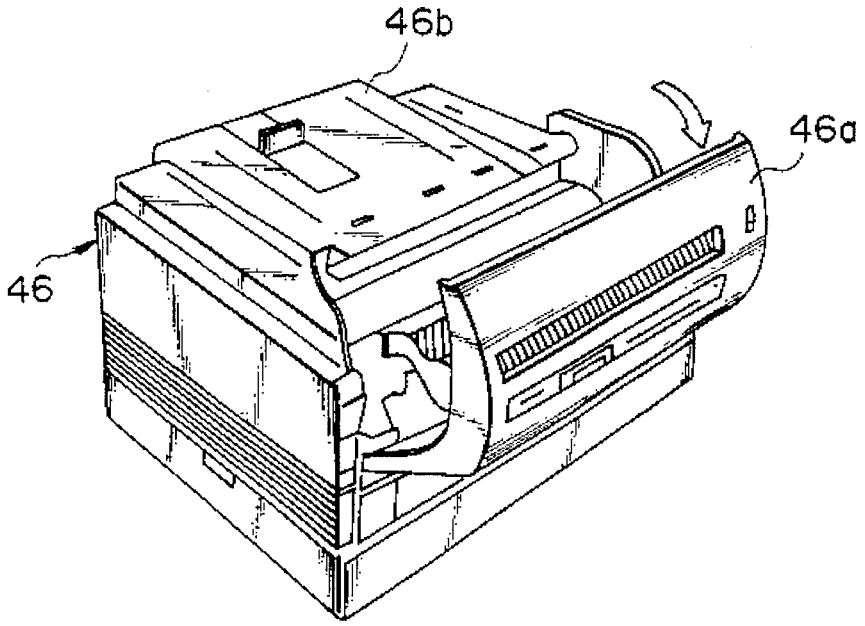
FIG. 8 is a perspective view of the laser printer shown in FIG. 7, in which a front cover is opened.
Figure 9:
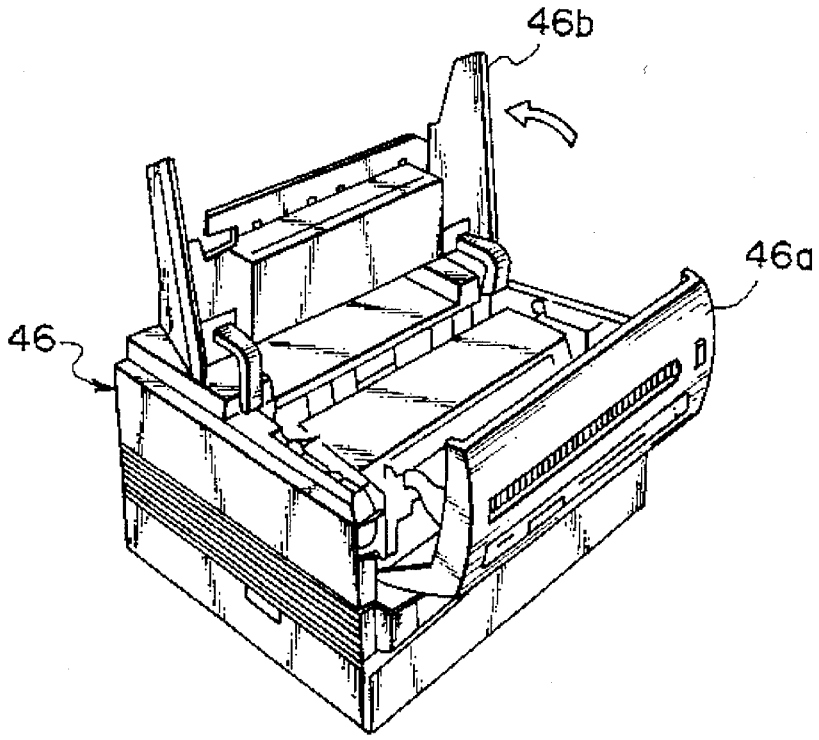
FIG. 9 is a perspective view of the laser printer shown in FIG. 7, in which an upper cover is further opened.

FIGS. 7 to 18 show a second embodiment of a toner image fixing device according to the present invention. FIGS. 7 to 9 show the appearance of a personal use type compact laser printer as an example of the electrophotographic laser printer, in which the toner image fixing device according to the present invention is assembled. The printer comprises a printer housing 46 including a movable front cover 46*a* as a part thereof, and the front cover 46*a* can be moved from a closed position shown in FIG. 7 to an open position shown in FIG. 8. The printer housing 46 also includes a movable upper cover 46*b* as a part thereof, and the upper cover 46*b* can be moved from a closed position shown in FIG. 7 to an open position shown in FIG. 9. A top surface of the upper cover 46*b* serves as a paper receiver for a printed paper. To this end, the upper cover has a paper stopper 48 provided on the top surface thereof, and, when a printed paper is discharged from the printer, the leading edge of the printed paper is abutted against the paper stopper 48.

Figure 10:
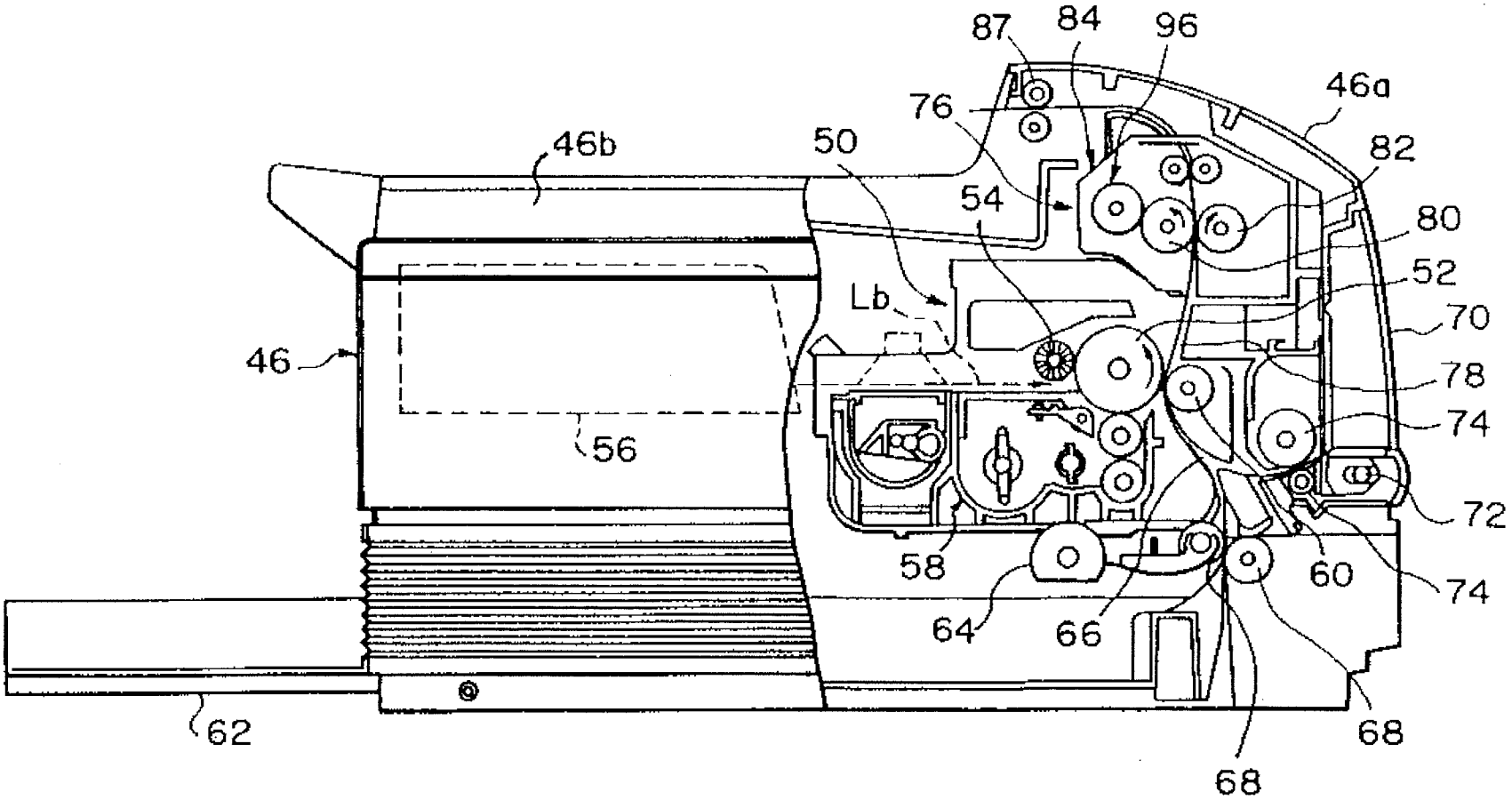
FIG. 10 is a partially cutaway side view of the laser printer as shown in FIG. 7, schematically illustrating a main part of an interior arrangement thereof.
Figure 11:
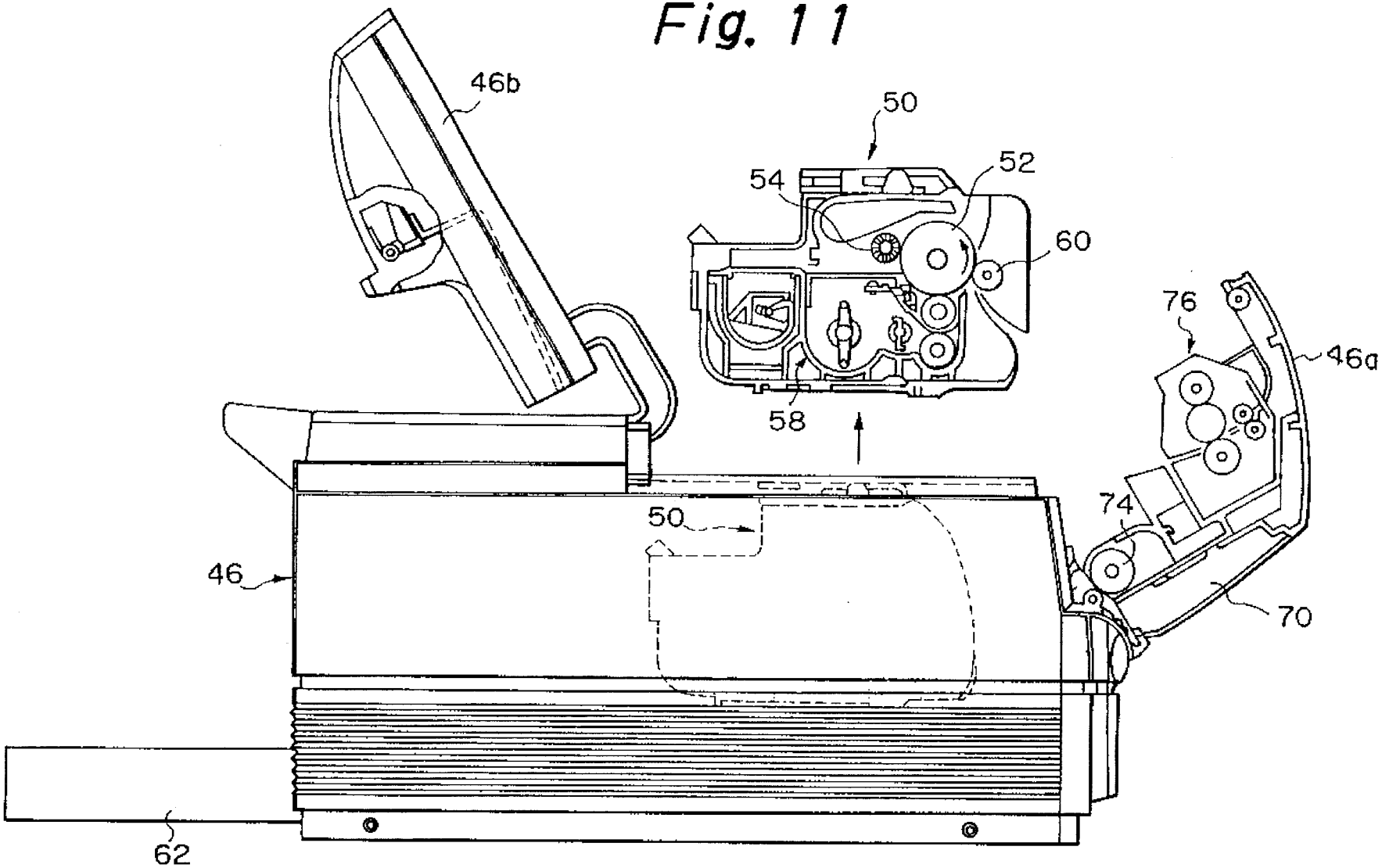
FIG. 11 is a side view of the laser printer shown in FIG. 7, in which the front and upper covers are opened to remove a printing unit from the laser printer.

FIG. 10 schematically shows a part of an interior arrangement of the printer shown in FIGS. 7 to 9. The printer comprises a printing unit 50 provided in the housing 46, and the printing unit 50 prints on a recording medium such as a sheet of paper. As shown in FIG. 11, when the front and upper covers 46*a* and 46*b* are opened, the printing unit 50 is removable from the housing 46, and thus maintenance of the printer can be easily carried out.

Figure 12:
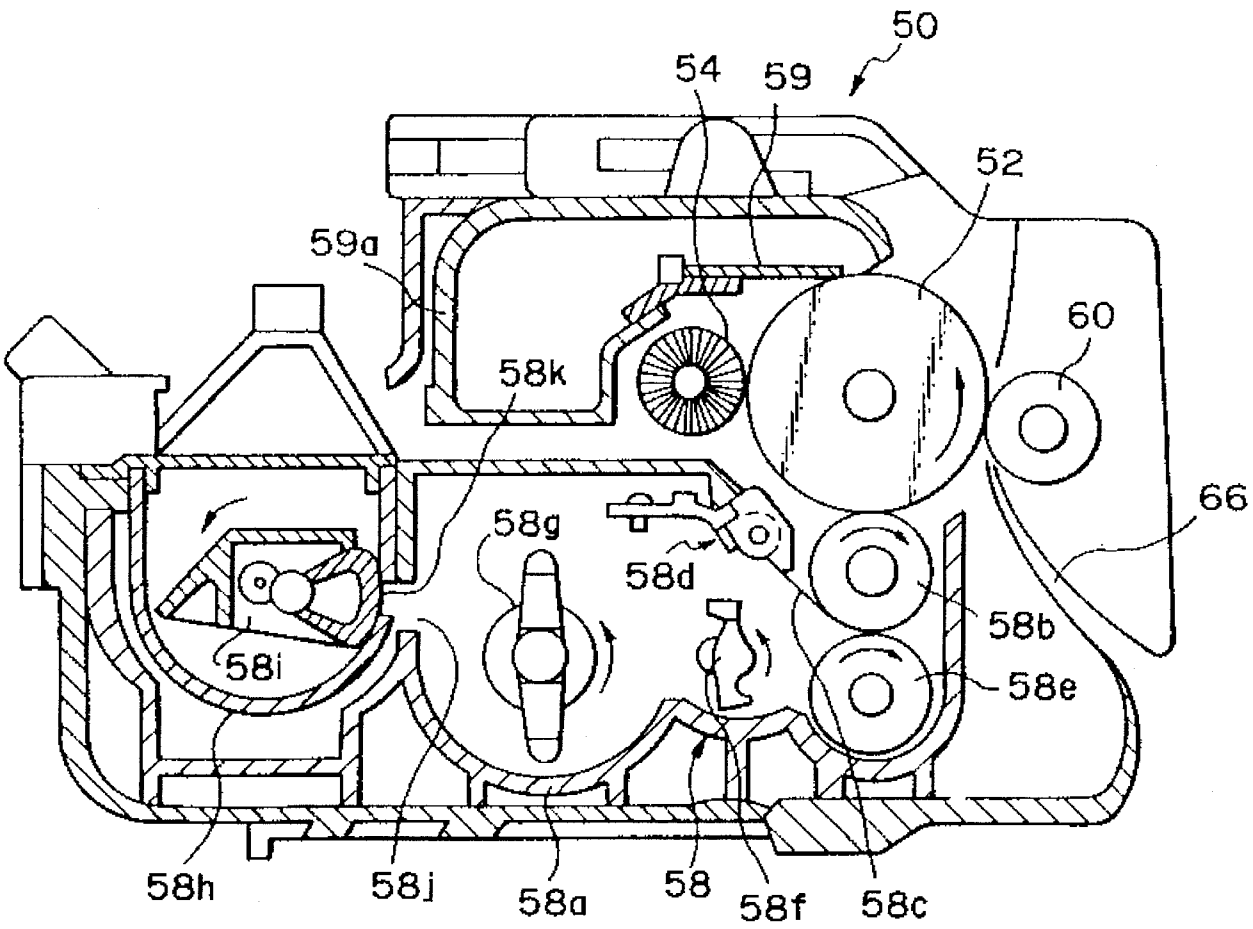
FIG. 12 is an enlarged sectional side view of the printing unit shown in FIG. 11.

As best shown in FIG. 12, the printing unit 50 comprises a rotary photosensitive drum 52 formed as a latent image carrying body and rotated in a direction indicated by an arrow in FIG. 12 during an operation of the printer. The drum 52 may be made of an aluminum cylindrical hollow member and a photoconductive insulating film bonded to a cylindrical surface thereof. In this embodiment, the photoconductive insulating film is made of an organic photoconductor (OPC).

The printing unit 14 also comprises a conductive brush type charger 54 formed of a plurality of conductive filaments and rotated such that the free ends of the filaments are in contact with the photosensitive drum 52. The charger 54 is connected to an electronic power source (not shown) to apply electric charges to the photoconductive insulating film of the drum 52, so that a uniform distribution of the charges is produced on the drum 52. For example, the charged area of the drum 52 may have a potential of about −600 volts. As shown in FIG. 10, the printer comprises a laser beam scanner 56 including a laser source such as a semiconductor laser diode for emitting a laser light, an optical system for focusing the laser light into a laser beam LB, and an optical scanning system such as a polygon mirror for deflecting the laser beam LB along a direction of a central axis of the drum 52, so that the charged area of the drum 52 is scanned by the deflecting laser beam LB. During the scanning, the laser beam LB is switched on and off on the basis of binary image data obtained from, for example, a word processor, computer or the like, so that an electrostatic latent image is written as a dot image on the charged area of the drum 52. In particular, when a zone of the charged area is irradiated by the laser beam LB, the charges are released from the irradiated zone so that the latent image is formed as a potential difference between the irradiated zone and the remaining zone.

The printing unit 50 further comprises a developing device 58 for electrostatically developing the latent image with, for example, a non-magnetic one-component developer composed of colored fine resin particles (toner). The developing device 58 includes a vessel 58*a* for holding the developer or toner, and a developing roller 58*b* provided within the vessel 58*a* in such a manner that a portion of the developing roller 58*b* is exposed therefrom and pressed against the surface of the photosensitive drum 52 to establish a given nip width therebetween. The developing roller 58*b* is formed as a conductive foam rubber roller, which may be made of a conductive polyurethane foam rubber material. During the operation of the printer, the developing roller 58*b* is rotated in a direction indicated by an arrow in FIG. 12, and frictionally entrains the toner particles to form a developer or toner layer therearound, whereby the toner particles are brought to the surface of the drum 52 for development of the latent image formed thereon.

The developing device 58 also includes a blade member 58*c* supported by the vessel 58*a* through attachment fittings, generally indicated by reference 58*d*, such that the blade member 58*c* is engaged with a surface of the developing roller 58*b* to make the thickness of the toner layer formed therearound uniform, whereby an even development of the latent image can be ensured. The blade member 58*c* may be formed of stainless steel having a thickness of about 0.1 mm, and is subjected to an application of a voltage of about −400 volts, so that the toner particles are negatively charged by a charge-injection effect. During the developing process, the developing roller 58*b* is subjected to a developing bias voltage of −300 volts, the negative charged toner particles are electrostatically adhered to only the latent image zone having the potential of about −100 volts, as the latent image zone is charged with the negative particles.

The developing device 58 further includes a toner-removing roller 58*e* rotatably provided within the vessel 58*a* and resiliently pressed against the developing roller 58*b*. The toner-removing roller 58*e* is rotated in the same direction as the developing roller 58*b*, as indicated by an arrow in FIG. 12, so that the surfaces of the rollers 58*b* and 58*e* are rubbed against each other in reverse directions at the contact zone therebetween, whereby residual toner particles not used for the development of the latent image are mechanically removed from the developing roller 58*b*. On the other hand, the toner-removing roller 58*e* serves to feed the toner particles to the developing roller 58*b* at one side of the nip therebetween (i.e., the left side in FIG. 12), because the toner particles entrained by the toner-removing roller 58*e* are moved toward the nip between the rollers 58*b* and 58*e*. The toner-removing roller 58*e* is also formed as a conductive foam rubber roller, which may be made of a conductive polyurethane foam rubber material. The toner-removing roller 58*e* is subjected to application of a voltage of about −400 volts to thereby be negatively charged, so that a penetration of the toner particles thereinto can be prevented.

Figure 13:
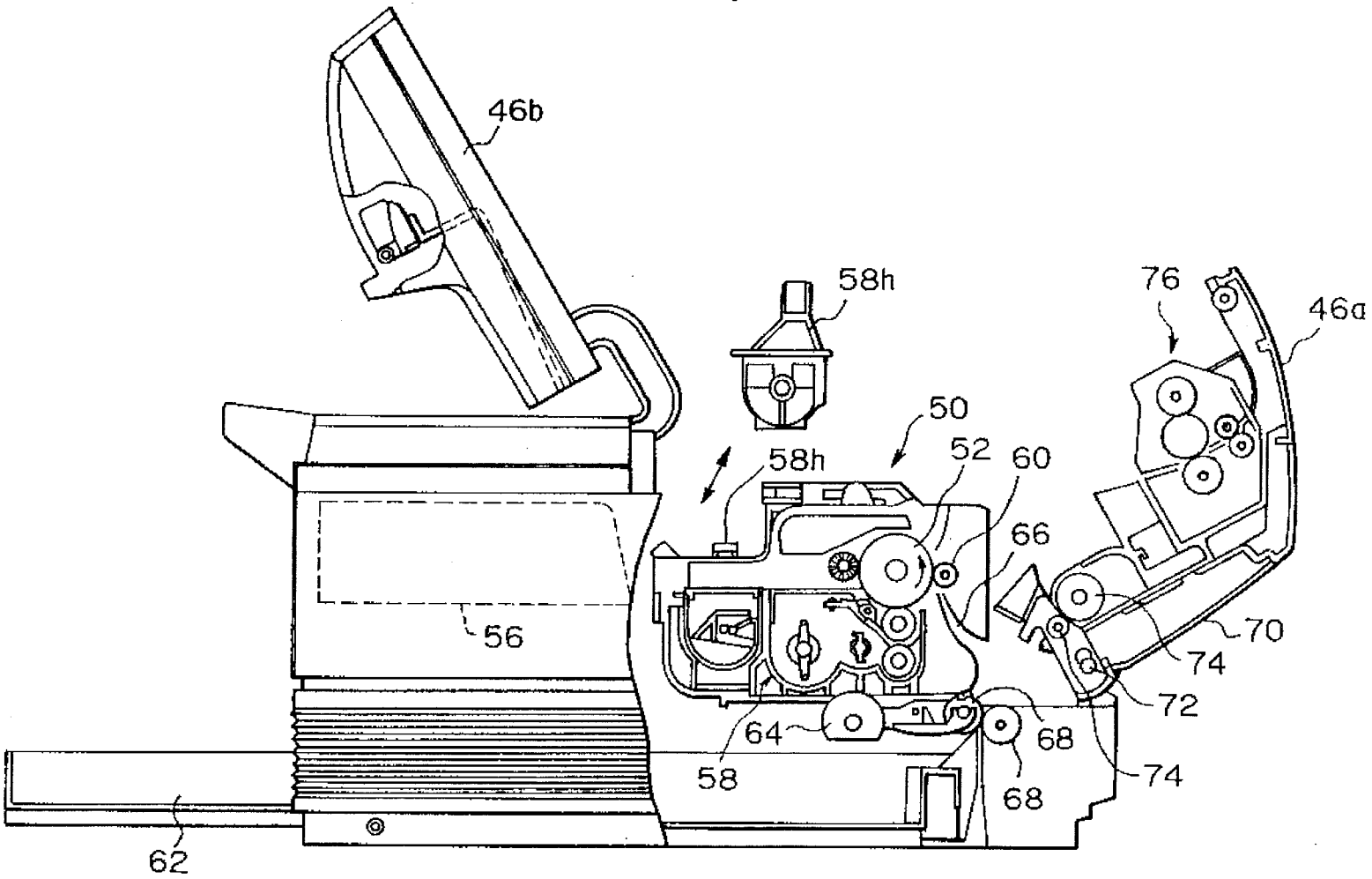
FIG. 13 is a partially cutaway side view of the laser printer as shown in FIG. 7, in which the front and upper covers are opened for an exchange of a toner tank.

The vessel 58*a* may be provided with a paddle roller 58*f* and an agitator 58*g* rotated in directions indicated by arrows in FIG. 12, respectively. The paddle roller 58*f* serves to move the toner particles toward the toner-removing roller 58*e*, and the agitator 58*g* agitates the body of the toner to eliminate dead stock thereof from the vessel 58*a*. Also, the developing device 58 may also be provided with a developer-supplying tank 58*h* detachably received therein and having a paddle blade 58*i* rotated in a direction indicated by an arrow in FIG. 12. The vessel 58*a* has an opening 58*j* formed in a side wall thereof, and the tank 58*h* has a port 58*k* formed therein. The vessel 58*a* is in communication with the tank 58*h* through the opening 58*j* and the port 58*k*, as shown in FIG. 12. When a predetermined amount of the developer is consumed from the vessel 58*a*, the rotation of the paddle blade 58*i* is carried out, whereby the developer is fed from the tank 58*h* to the vessel 58*a*. When the tank 58*h* becomes empty, it is exchanged for a new one, as shown in FIG. 13.

The printing unit 50 further includes a conductive roller type transfer charger 60 for electrostatically transferring the developed toner image from the photosensitive drum 52 to a cut sheet paper. The transfer charger 60 is also formed as a conductive foam rubber roller, which may be made of a conductive polyurethane foam rubber material. The transfer roller 60 is resiliently pressed against the drum 52, and is subjected to an application of an electric energy so that positive charges are supplied to the paper, whereby the negatively-charged toner image can be electrostatically attracted to the paper.

As shown in FIG. 10, the printer is provided with a detachable paper cassette 62 in which a stack of cut sheet paper is received, and the paper cassette 62 has a paper feeding roller 64 incorporated therein. A paper guide 66 is extended from the paper cassette 62 toward a nip between the drum 52 and the transfer roller 60, and has a pair of register rollers 68 and 68 associated therewith. During the printing operation, papers to be printed are fed one by one from the stack of paper by driving the paper feeding roller 64. The fed paper is stopped once at the register rollers 68 and 68, and is then introduced into said nip through the paper guide 66 at a given timing, so that the developed toner image can be transferred to the paper in place.

In the toner image transferring process, the developed toner image cannot be completely transferred from the drum 52 to the paper. Namely, a part of the developed toner image is inevitably left as residual toner particles on the surface of the drum 52. The residual toner particles are removed from the drum surface by a scraper type blade 59 applied thereto, and the removed toner particles are received in a vessel 59*a*.

In the illustrated printer, a cut sheet paper can be manually introduced into the nip between the drum 52 and the transfer roller 60. To this end, the front cover 46*a* has a movable guide plate 70 associated therewith, and the guide plate 70 is rotatable at a pivot pin 72. When the guide plate 70 is moved from a vertical position shown in FIG. 10 to a horizontal position, the cut sheet paper can be manually set on the horizontally positioned guide plate 70 such that the leading edge thereof is abutted against a nip between a pair of paper feeding rollers 74 and 74. By driving the paper feeding rollers 74 and 74, the cut sheet paper is fed to the nip between the drum 52 and the transfer roller 60.

Figure 14:
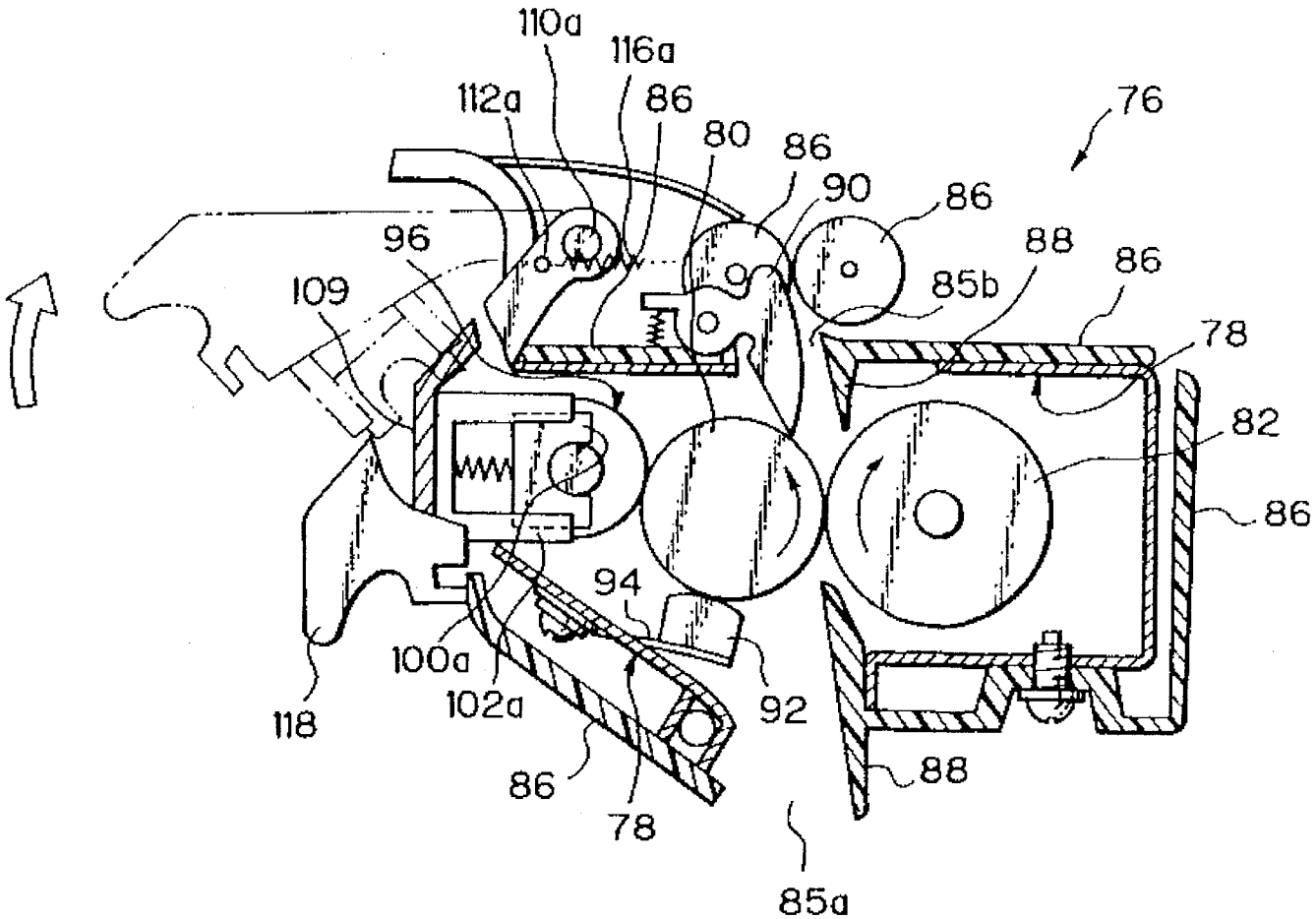
FIG. 14 is a side view of the fixing device used in the laser printer of FIG. 7, illustrating main elements of the fixing device.
Figure 15:
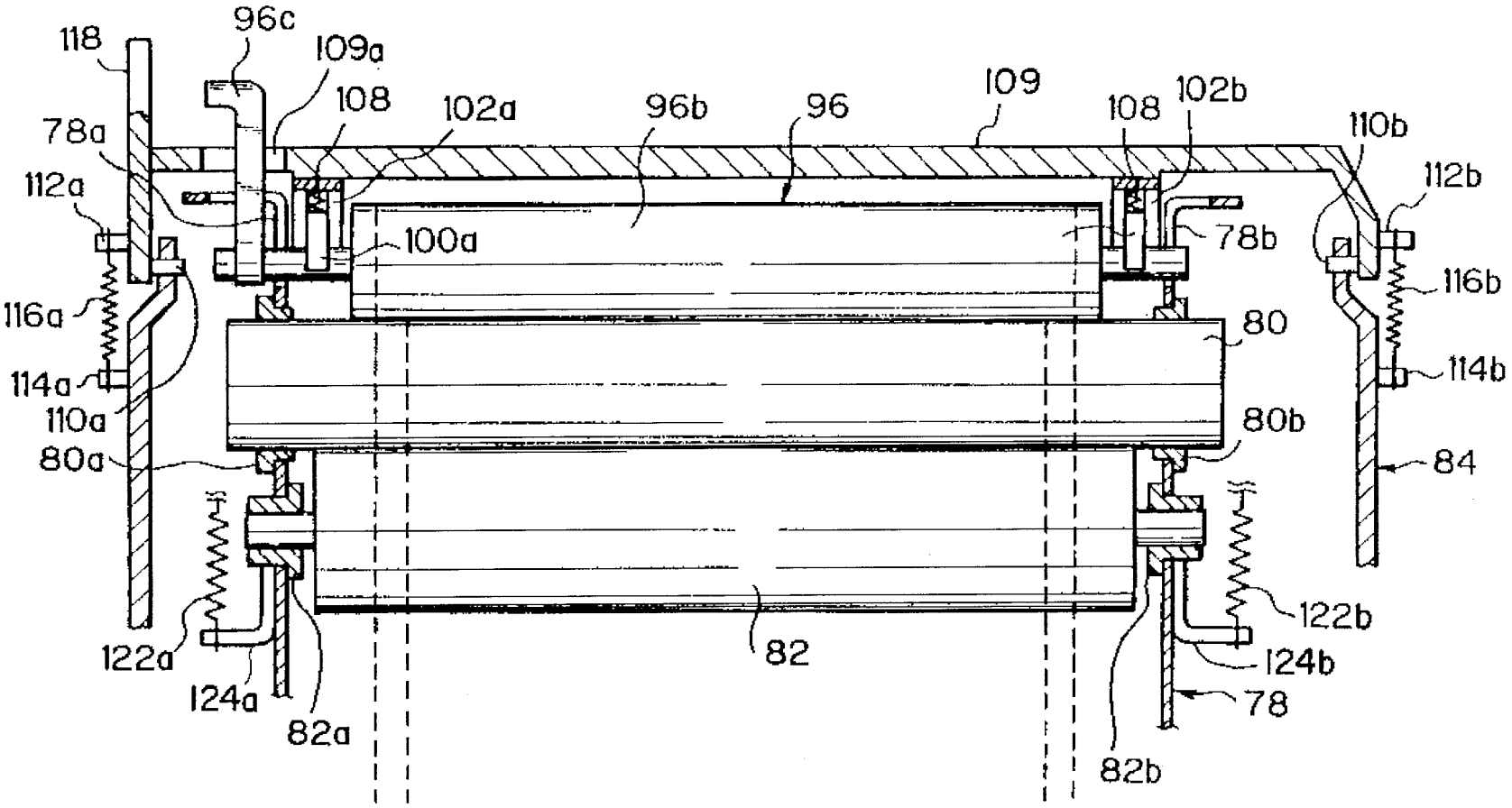
FIG. 15 is a partially sectional plane view of the fixing device used in the laser printer of FIG. 7, illustrating main elements of the fixing device.

The paper discharged from the nip between the drum 52 and the transfer roller 60, i.e., the paper carrying the transferred toner image, is then moved toward a toner image fixing device 76 along a paper guide 78 extended between the transfer roller 60 and the fixing device 76, for thermally fusing and fixing the transferred toner image on the paper. As apparent from FIGS. 10 and 11, in this embodiment, the fixing device 76 is supported by the movable front cover 46*a*. As best shown in FIGS. 14 and 15, the fixing device 76 comprises a metal frame 78 made of a suitable metal material such as stainless steel that is securely supported by the front cover 46*a*, a heat roller 80 rotatably supported by the metal frame 78 through a pair of bearings 80*a* and 80*b*, and a backup roller 82 rotatably supported by the metal frame 78 through a pair of bearings 82*a* and 82*b* and engaged with the heat roller 80 to form a nip therebetween, and these elements 78, 80 and 82 are housed by a casing 84 supported by the movable front cover 46*a*. The rollers 80 and 82 are rotated in respective directions indicated by arrows in FIG. 14 during an operation of the printer.

The paper is introduced into the nip between the rollers 80 and 82 through an inlet port formed in the casing 84 and through an inlet opening 85*a* formed in the metal frame 78 (FIGS. 10 and 14). While the paper is passed through said nip, the toner image thereon is in direct contact with the heat roller 80, and thus is thermally fused and fixed on the paper. The paper carrying the fixed toner image, which is passed through the nip between the rollers 80 and 82, is discharged from the metal frame 78 through an outlet opening 85*b* formed therein, and is then directed to an outlet port formed in the casing 84, by a pair of paper guide rollers 86 and 86 disposed beside the outlet opening 85*b*. Thus, the paper passed through the fixing device 84 is discharged from the printer through a pair of paper discharging rollers 87 and 87, and then the discharged papers are successively stacked on the top surface of the upper cover 46*b*.

As shown in FIG. 14, the metal frame 78 is covered by a plurality of plate-like members 86 made of a heat resistant material such as polybutylene terephtalate, and some plate-like members are extended so as to form a guide element 88 to define the inlet and outlet openings 85*a* and 85*b*. A wedge-shaped element 90 is pivotally attached to the metal frame 78, and is resiliently pressed against the surface of the heat roller 80 for mechanically separating the leading edge of the paper therefrom. Also, a thermistor 92 is supported by the metal frame 78 through the intermediary of a leaf spring element 94 so as to be in resilient contact with the surface of the heat roller 80 for controlling the temperature of the heat roller 80 within a given range.

Figure 16:
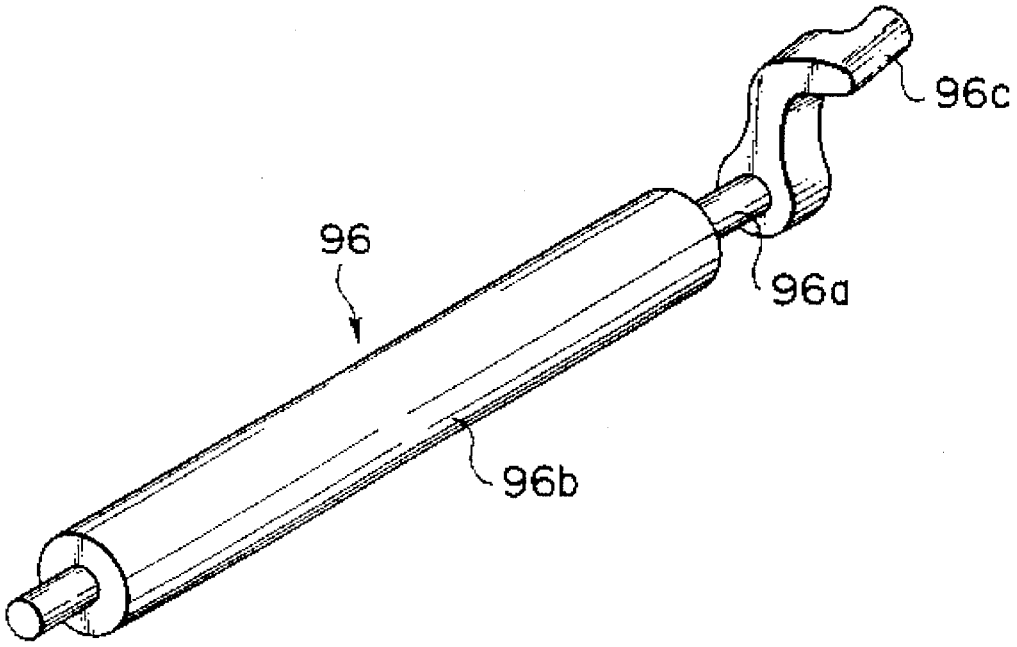
FIG. 16 is a perspective view of a cleaning roller member used in the fixing device of FIGS. 14 and 15.
Figure 17:
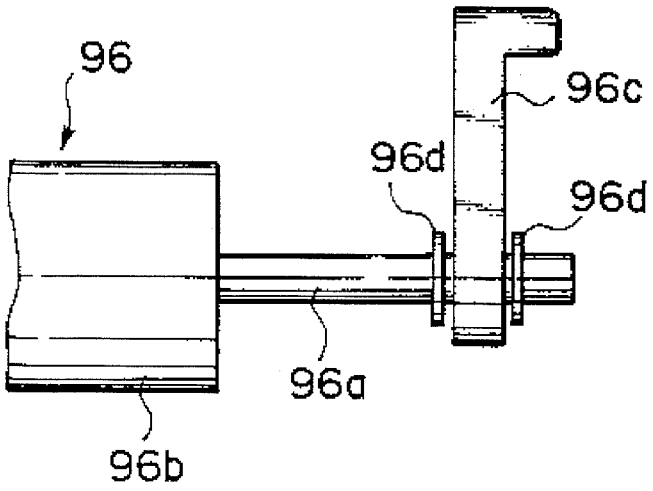
FIG. 17 is a partial rear view of the cleaning roller member shown in FIG. 16.

The toner image fixing device 76 further comprises a cleaning roller member 96 constituted according to the present invention. As best shown in FIG. 16, the cleaning roller member 96 includes a shaft element 96*a* made of a suitable metal material such as stainless steel, aluminium or the like, a cleaning roller element 96*b* mounted on the shaft element 96*a* and made of a suitable cleaning material such as felt (which is, for example, available as 545K from Toyobo K.K.), and a handle element 96*c* rotatably mounted on one end of the shaft element 96*a*. The cleaning roller element 96*b* may be formed by winding a strip-like felt material around the shaft element 96*a*. As shown in FIG. 17, a pair of E-rings 96*d* and 96*d* are mounted on the shaft element 96*a* at sides of the handle element 96*c* for restraining a movement of the handle element 96*c* along the shaft element 96*a*.

Figure 18:
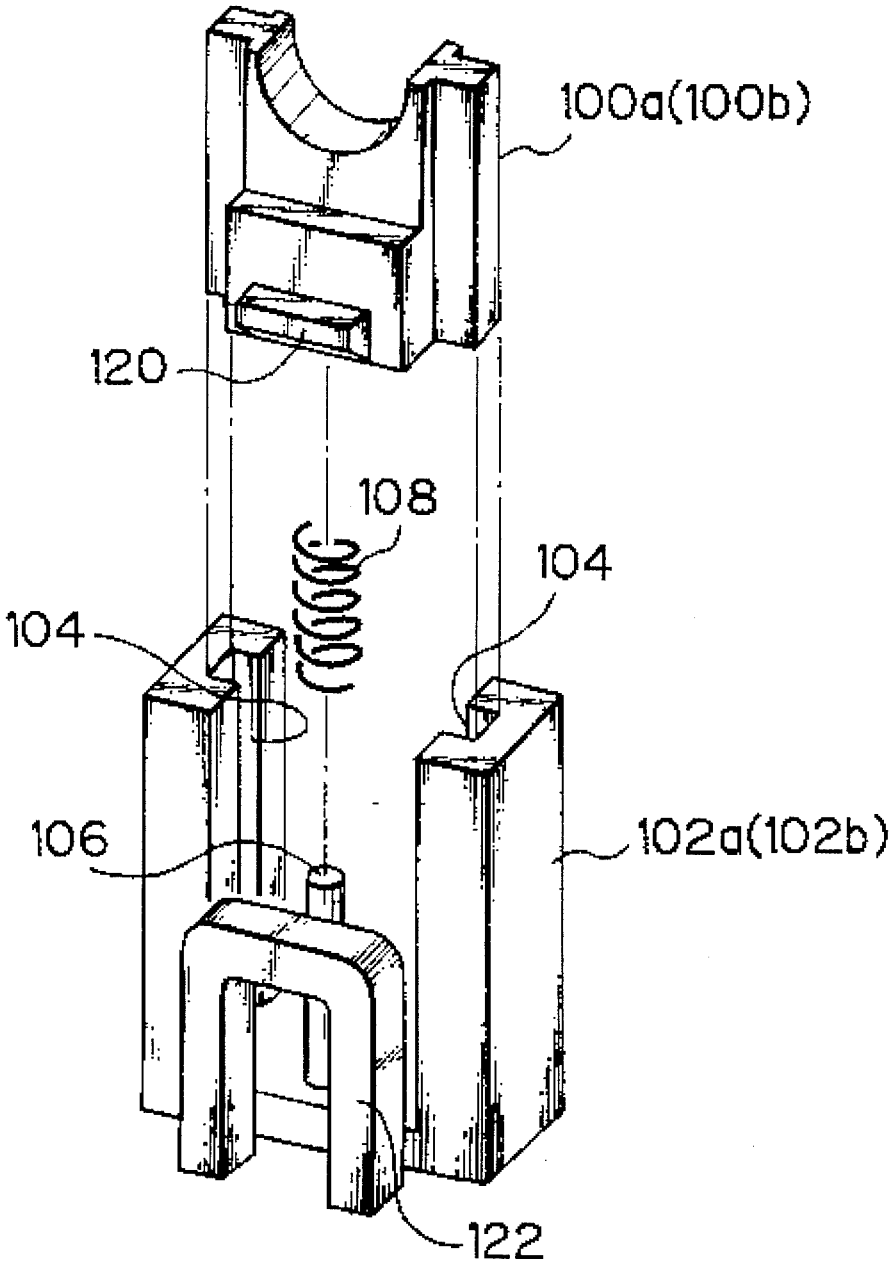
FIG. 18 is a perspective view showing a bearing element for the cleaning roller member shown in FIG. 17, and a U-shaped guide element slidably receiving the bearing element.

The cleaning roller member 96 is detachably and rotatably supported by the metal frame 78 such that the roller element 98*b* is resiliently pressed against the surface of the heat roller 80, whereby the cleaning roller member 96 can be rotated together with the heat roller 80 by a friction force acting therebetween. In particular, as shown in FIG. 15, the ends of the shaft element 96*a* are rotatably received in two side slots 78*a* and 78*b* formed in the metal frame 78, and are constrained in the side slots 78*a* and 78*b* by two bearing elements 100*a* and 100*b* which are slidably received within two U-shaped guide members 102*a* and 102*b*, respectively (FIG. 15). As best shown in FIG. 18, each of the leg portions of the U-shaped guide member 102*a*, 102*b* has a guide slot 104 formed therein for slidably receiving a corresponding side edge of the bearing elements 100*a*, 100*b*. Also, each of the U-shaped guide members 102*a*, 102*b* is provided with a coil spring 108 inserted onto a guide pin 106 protruded from the base portion thereof, so that the bearing elements 100*a*, 100*b* are resiliently biased outward. Namely, when the respective ends of the shaft element 96*a* are constrained in the side slots 78*a* and 78*b* by the bearing elements 100*a* and 100*b*, as shown in FIGS. 14 and 15, the cleaning roller member 96 is resiliently pressed against the heat roller 80.

The U-shaped guide members 102*a* and 102*b* are securely fixed to an inner wall face of a movable cover member 109 pivotally attached to side walls of the casing 84 by two pivot pins 110*a* and 110*b* which are inwardly protruded from end walls of the cover member 109, and the cover member 109 is movable between a closed position shown by a solid line and an open position shown by a phantom line, as shown in FIG. 14. The end walls of the cover member 109 have pins 112*a* and 112*b* outwardly protruded therefrom and offset from the pivot pins 110*a* and 110*b*, and the side walls of the casing 78 have pins 114*a* and 114*b* outwardly protruded therefrom. Two tension coil springs 116*a* and 116*b* act between the pins 112*a* and 114*a* and between the pins 112*b* and 114*b*, respectively. As apparent from FIGS. 14 and 15, one of the end walls of the cover member 109 is integrally extended to form a lever 118. A resilient force of the tension coil springs 116*a* and 116*b* is larger than that of the coil springs 108 and 108. Accordingly, the movable cover member 108 is usually kept at the closed position because it subjected to a counterclockwise (FIG. 14) resilient force derived from the tension coil springs 116*a* and 116*b*. When the cover member 109 is moved from the closed position to the open position against the resilient force of the tension coil springs 116*a* and 116*b* by lifting up the lever 118 with a person's finger, the cover member 109 is kept at the open position because the pin 112*a*, 112*b* clears the dead point so that it is subjected to a clockwise (FIG. 14) resilient force derived from the tension coil springs 116*a* and 116*b*.

When the cover member 109 is at the open position, the bearing elements 100*a*, 100*b* should be prevented from slipping out of the U-shaped guide members 102*a*, 102*b*. To this end, the bearing elements 100*a*, 100*b* each have a projection 120 protruded therefrom, as shown in FIG. 18, and the projection 120 is engaged in a U-shaped stopper element 122 securely fixed to the inner wall face of the cover member 108.

With the arrangement as mentioned above, an exchange of the cleaning roller member 96 can be carried out by the following steps of:

1) moving the front cover 46*a* of the printer housing 46 from the closed position to the open position;

2) moving the cover member 109 from the closed position to the open position;

3) replacing an old cleaning roller member with a new one;

4) moving the cover member 109 from the open position to the closed position; and 5) moving the front cover 46*a* from the open position to the closed position.

These steps are not troublesome. In particular, the replacing step can be quickly performed because the cleaning roller member can be handled by griping the handle element 96*c* with a person's hand. Note, the movable cover member 109 has an opening 109*a* through which the handle element 96*c* is passed when in the closed position.

As shown in FIG. 15, two tension springs 122*a* and 122*b* may act on the bearings 82*a* and 82*b* of the backup roller 82 through L-shaped abutment elements 124*a* and 124*b*, respectively, so that play can be eliminated as much as possible from the backup roller 82, to thereby press it against the heat roller 80 with a larger pressure. In this case, similar to the cleaning roller member 96, the backup roller 82 can be also rotated together with the heat roller 80 by a frictional force acting therebetween without use of a gear train for transmitting a drive force to the backup roller 82.

Preferably, the cleaning roller element 96*b* may be impregnated with a silicone oil to facilitate a cleaning of the heat roller 80, in the same manner as mentioned above. Namely, the impregnation of the silicone oil should be restricted to only a central zone CL of the cleaning roller element 96*b* corresponding to a recording zone of the paper.

In the embodiments as mentioned above, preferably, a ratio between an outer diameter of the cleaning roller member and an outer diameter of the heat roller is a non-integral number so that a cleaning area of the cleaning roller member can be uniformly stained. Namely, if the ratio is an integral number, the cleaning area of the cleaning roller member may be locally stained to thereby cause a premature deterioration thereof.

Finally, it will be understood by those skilled in the art that the foregoing description is of preferred embodiments of the present invention, and that various changes and modifications can be made without departing from the spirit and scope thereof.

We claim:

1. A toner image fixing device comprising:

heat roller means rotationally driven in a direction for passing therethrough a recording medium with a toner image to thermally fuse and fix the toner image on the recording medium;

cleaning roller means pressed against said heat roller means for rotation together therewith to clean said heat roller means stained with the fused toner image; and frame means for rotatably supporting said cleaning roller means, said cleaning roller means having two beating elements by which the two ends of said cleaning roller means are rotatably received, and said frame means having two holes aligned with and spaced from each other such that said cleaning roller means is longitudinally introduced into the aligned holes, so that said bearing elements are detachably received in and held by said aligned holes, wherein said frame means includes first holder means provided in one of said holes for resilient engagement with the corresponding one of said beating elements, and a ratio between an outer diameter of said heat roller means and an outer diameter of said cleaning roller means is a non-integral number, whereby said cleaning roller means is uniformly stained.

2. A toner image fixing device comprising:

heat roller means rotationally driven in a direction for passing therethrough a recording medium with a toner image to thermally fuse and fix the toner image on the recording medium;

cleaning roller means pressed against said heat roller means for rotation together therewith to clean said heat roller means stained with the fused toner image; and frame means for rotatably supporting said cleaning roller means, said cleaning roller means having a first bearing element by which an end of said cleaning roller means is rotatably received, and said frame means having two holes aligned with and spaced from each other such that said cleaning roller means is longitudinally introduced into the aligned holes in such a manner that a free end of said cleaning roller means is defined as a leading edge, so that said first bearing element and said free end are detachably received in and held by said aligned holes, respectively wherein said frame means includes a second bearing element provided in the hole associated with the free end of said cleaning roller means, and said free end is received in and held by said second bearing element, and a ratio between an outer diameter of said heat roller means and an outer diameter of said cleaning roller means is a non-integral number, whereby said cleaning roller means is uniformly stained.

3. A toner image fixing device comprising:

heat roller means rotationally driven in a direction for passing therethrough a recording medium with a toner image to thermally fuse and fix the toner image on the recording medium;

cleaning roller means pressed against said heat roller means for rotation together therewith to clean said heat roller means stained with the fused toner image;

frame means having two slots aligned with and spaced from each other such that both ends of said cleaning roller means are laterally introduced into the aligned holes; and constraint means for rotatably constraining the ends of said cleaning roller means in said slots of said frame means, said constraint means being movable between a closed position at which the ends of said cleaning roller means are rotatably constrained and an open position at which said cleaning roller means is removable from the slots of said frame means.

4. A toner image fixing device as set forth in claim 3, wherein said removable constraint means includes a resilient means for resiliently constraining the ends of said cleaning roller means in said slots.

5. A toner image fixing device as set forth in claim 3, wherein said constraint means is supported by a movable member which is movable between a first position that allows said constraint means to constrain the ends of said cleaning roller means and a second position that makes it impossible for said constraint means to constrain the ends of said cleaning roller means.

6. A toner image fixing device as set forth in claim 3, wherein said removable constraint means includes a resilient means for resiliently constraining the ends of said cleaning roller means in said slots.

7. A toner image fixing device as set forth in claim 5, further comprising a resilient tension means for resiliently keeping said movable member at said first position.

8. A toner image fixing device as set forth in claim 7, wherein there is an equilibrium position between the first and second positions and said resilient tension means is arranged so as to bias said movable member toward said second position when said movable member is moved between the equilibrium position and the second position, the resilient tension means resiliently keeping the movable member in the second position when the movable member is moved to the second position.

9. A toner image fixing device as set forth in claim 3, wherein said cleaning roller means includes a roller element made of a felt material, and only a central zone corresponding to a recording area of the recording medium is impregnated with a silicone oil to facilitate the cleaning of the heat roller means.

10. A toner image fixing device as set forth in claim 3, wherein said cleaning roller means includes a handle element for manually handling said cleaning roller means.

11. A toner image fixing device comprising:

heat roller means rotationally driven in a direction for passing therethrough a recording medium with a toner image to thermally fuse and fix the toner image on the recording medium;

cleaning roller means pressed against said heat roller means for rotation together therewith to clean said heat roller means stained with the fused toner image;

frame means having two slots aligned with and spaced from each other such that both ends of said cleaning roller means are laterally introduced into the aligned holes; and removable constraint means for detachably constraining the ends of said cleaning roller means in said slots such that the cleaning roller is rotatably supported by said frame means, and wherein a ratio between an outer diameter of said heat roller means and an outer diameter of said cleaning roller means is a non-integral number, whereby said cleaning roller means is uniformly stained.

12. A toner image fixing device comprising:

a heat roller rotationally driven in a direction for passing therethrough a recording medium with a toner image to thermally fuse and fix the toner image on the recording medium, said heat roller having a first end and a second end;

a cleaning roller pressed against said heat roller for rotation together therewith to clean said heat roller stained with the toner image, said cleaning roller having a first end and a second end;

a first bearing element provided at the first end of said cleaning roller;

a second bearing element provided at the second end of said cleaning roller;

a first side wall member provided at a side of the first end of said heat roller and having a first hole formed therein for receiving and holding said first bearing element; and a second side wall member provided at a side of the second end of said heat roller and having a second hole formed therein for receiving and holding said second bearing element, and wherein said first and second holes are aligned with each other, and at least one of said first and second holes is constructed to allow passage of said cleaning roller therethrough.

13. A toner image fixing device as set forth in claim 12, wherein said first side wall member includes a first holder provided in the first hole thereof for resilient engagement with said first bearing element.

14. A toner image fixing device as set forth in claim 13, wherein said first holder comprises a socket type holder.

15. A toner image fixing device as set forth in claim 13, wherein said second side wall member includes a second holder provided beside the second hole thereof for resilient engagement with said second bearing element.

16. A toner image fixing device as set forth in claim 15, wherein said second holder comprises a leaf spring type holder.

17. A toner image fixing device as set forth in claim 12, wherein said cleaning roller includes a roller element made of a felt material, and only a central zone corresponding to a recording area of the recording medium is impregnated with a silicone oil to facilitate the cleaning of the heat roller.

18. A toner image fixing device as set forth in claim 12, wherein a ratio between an outer diameter of said heat roller and an outer diameter of said cleaning roller is a non-integral number, whereby said cleaning roller is uniformly stained.

19. A toner image fixing device comprising:

a heat roller rotationally driven in a direction for passing therethrough a recording medium with a toner image to thermally fuse and fix the toner image on the recording medium, said heat roller having a first end and a second end;

a cleaning roller pressed against said heat roller for rotation together therewith to clean said heat roller stained with the toner image, said cleaning roller having a first end and a second end which is formed as a free end;

a first bearing element provided at the first end of said cleaning roller;

a first side wall member provided at a side of the first end of said heat roller and having a first hole formed therein for receiving and holding said first bearing element; and a second side wall member provided at a side of the second end of said heat roller and having a second hole formed therein for rotatably receiving and holding the second end of said cleaning roller, and wherein said first and second holes are aligned with each other, and the first hole of said first side wall member is constructed to allow passage of said cleaning roller therethrough.

20. A toner image fixing device as set forth in claim 19, wherein said second side wall member includes a second bearing element provided therein in such a manner that said second bearing element defines said second hole for rotatably receiving and holding the second end of said cleaning roller.

21. A toner image fixing device as set forth in claim 19, wherein said first side wall member includes a holder provided beside the first hole thereof associated with said first bearing element, to be resiliently engaged therewith.

22. A toner image fixing device as set forth in claim 21, wherein said holder comprises a leaf spring type holder.

23. A toner image fixing device as set forth in claim 19, wherein said cleaning roller includes a roller element made of a felt material, and only a central zone corresponding to a recording area of the recording medium is impregnated with a silicone oil to facilitate the cleaning of the heat roller.

24. A toner image fixing device as set forth in claim 19, wherein a ratio between an outer diameter of said heat roller and an outer diameter of said cleaning roller is non-integral number, whereby said cleaning roller is uniformly stained.

* * * * *

UNITED STATES PATENT AND TRADEMARK OFFICE

CERTIFICATE OF CORRECTION

PATENT NO. : 5,543,903

DATED : August 6, 1996

INVENTOR(S) : Nobuo FUJITA et al.

It is certified that error appears in the above-indentified patent and that said Letters Patent is hereby corrected as shown below:

Col. 12, line 48, change "CL" to --CZ--.

Col. 13, line 18, change "beating" to --bearing--.

Col. 14, line 16, change "3" to --5--.

Signed and Sealed this

Fourth Day of February, 1997

*Attest:*

Bruce Lehman

BRUCE LEHMAN

*Attesting Officer*

*Commissioner of Patents and Trademarks*